US008669485B2

(12) United States Patent
Slepian et al.

(10) Patent No.: US 8,669,485 B2
(45) Date of Patent: Mar. 11, 2014

(54) REVERSAL PREVENTION OF A STORED ENERGY MECHANISM IN AN ELECTRICAL SWITCHING APPARATUS

(75) Inventors: Robert Michael Slepian, Murrysville, PA (US); Nathan James Weister, Darlington, PA (US)

(73) Assignee: Eaton Corporation, Cleveland, OH (US)

( * ) Notice: Subject to any disclaimer, the term of this patent is extended or adjusted under 35 U.S.C. 154(b) by 110 days.

(21) Appl. No.: 13/445,999

(22) Filed: Apr. 13, 2012

(65) Prior Publication Data

US 2013/0270084 A1 Oct. 17, 2013

(51) Int. Cl.
*H01H 5/00* (2006.01)

(52) U.S. Cl.
USPC ..... 200/400

(58) Field of Classification Search
USPC ..... 200/400; 337/6; 361/102
See application file for complete search history.

(56) References Cited

U.S. PATENT DOCUMENTS

| | | | | |
|---|---|---|---|---|
| 4,110,582 | A * | 8/1978 | Barkan | 200/400 |
| 4,137,436 | A * | 1/1979 | Barkan et al. | 200/400 |
| 4,507,641 | A * | 3/1985 | Poth | 337/6 |
| 7,186,937 | B1 * | 3/2007 | Ricciuti et al. | 200/400 |
| 7,459,650 | B2 | 12/2008 | Weister et al. | |
| 7,586,394 | B2 | 9/2009 | Spitsberg et al. | |
| 7,687,733 | B2 | 3/2010 | Weister et al. | |
| 7,696,448 | B2 | 4/2010 | Rakus et al. | |
| 2010/0089734 | A1 * | 4/2010 | Freundt | 200/400 |

* cited by examiner

*Primary Examiner* — Vanessa Girardi
(74) *Attorney, Agent, or Firm* — Eckert Seamans Cherin & Mellot, LLC; Grant E. Coffield

(57) ABSTRACT

A reversal prevention mechanism for an electrical switching apparatus, such as a circuit breaker, includes an actuator assembly pivotably coupled to the circuit breaker housing, a first stop element for controlling movement of the actuator assembly, a stop assembly pivotably coupled to the housing, and a second stop element for controlling movement of the stop assembly. The stored energy mechanism is movable among a charged position, a discharged position, and a contact touch position corresponding to a point at which the circuit breaker separable contacts make initial electrical contact. When the stored energy mechanism is disposed in the contact touch position, the stop assembly cooperates with the actuator assembly to prevent the stored energy mechanism from moving backwards.

14 Claims, 6 Drawing Sheets

REVERSAL PREVENTION OF A STORED ENERGY MECHANISM IN AN ELECTRICAL SWITCHING APPARATUS

BACKGROUND

1. Field

The disclosed concept relates generally to electrical switching apparatus and, more particularly, to electrical switching apparatus, such as circuit breakers. The disclosed concept also relates to closing assemblies and to reversal prevention mechanisms for electrical switching apparatus.

2. Background Information

Electrical switching apparatus, such as circuit breakers, provide protection for electrical systems from electrical fault conditions such as, for example, current overloads, short circuits, abnormal voltage and other fault conditions. Typically, circuit breakers include an operating mechanism, which opens electrical contact assemblies to interrupt the flow of current through the conductors of an electrical system in response to such fault conditions as detected, for example, by a trip unit. The electrical contact assemblies include stationary electrical contacts and corresponding movable electrical contacts that are typically mounted on moving (e.g., pivotable) arms.

Among other components, the operating mechanisms of some power air circuit breakers, for example, typically include a trip actuator assembly, a closing assembly and an opening assembly. The trip actuator assembly responds to the trip unit and actuates the operating mechanism. The closing assembly and the opening assembly may have some common elements, which are structured to move the movable electrical contacts between a first, open position, wherein the movable and stationary electrical contacts are separated, and a second, closed position, wherein the movable and stationary electrical contacts are electrically connected. Elements of both the closing assembly and the opening assembly move (e.g., pivot) in order to effectuate the closing and opening of the electrical contacts. A charging assembly, which includes a stored energy mechanism, is often employed to facilitate operation of the closing assembly.

It can be difficult for some circuit breakers to close on a relatively high current fault, commonly referred to as a Hi-IC. In order to clear the fault, it is desirable that the electromagnetic forces caused by the Hi-IC not be permitted to blow the moving arms back, towards their opening position, once electrical current begins to flow. Such a condition is commonly referred to as, "blow back." More specifically, at some level of fault current, the circuit breaker will not close completely (e.g., it stalls), and at even higher currents, the closing action will be reversed, blowing the arms and mechanism backwards. Separate devices exist for detecting a stalled condition, and to interact with the circuit breaker trip unit to fire the trip actuator and open the circuit breaker. The further the mechanism is from the fully closed position, the more difficult it is to trip the breaker for a given interruption current-induced electromagnetic force, because of poor mechanical advantage. Accordingly, preventing the moving arms and mechanism from blowing open facilitates the tripping process.

In stored energy circuit breakers where the stored energy mechanism (e.g., closing spring(s)) indirectly drive the mechanism through a cam shaft, a relatively complicated mechanical clutch on the cam shaft is used to prevent the mechanism from undesirably moving backwards. In other designs, such as for example where the stored energy mechanism (e.g., closing spring(s)) directly drives the mechanism, such a cam shaft clutch is ineffective.

There is, therefore, room for improvement in electrical switching apparatus, such as circuit breakers, and in closing assemblies and reversal prevention mechanisms therefor.

SUMMARY

These needs and others are met by embodiments of the disclosed concept, which are directed to a reversal protection mechanism for a closing assembly of an electrical switching apparatus, such as a circuit breaker. Among other benefits, the reversal protection mechanism cooperates with the stored energy mechanism (e.g., without limitation, closing spring (s)) to prevent undesired blow-backs, without inhibiting recharging of the spring(s).

As one aspect of the disclosed concept, a reversal prevention mechanism is provided for a closing assembly of an electrical switching apparatus. The electrical switching apparatus includes a housing, separable contacts enclosed by the housing, and an operating mechanism for opening and closing the separable contacts. The closing assembly includes a stored energy mechanism. The reversal prevention mechanism comprises: an actuator assembly structured to be pivotably coupled to the housing; a first stop element for controlling movement of the actuator assembly; a stop assembly structured to be pivotably coupled to the housing; and a second stop element for controlling movement of the stop assembly. The stored energy mechanism is movable among a charged position, a discharged position, and a contact touch position corresponding to a point at which the separable contacts make initial electrical contact. When the stored energy mechanism is disposed in the contact touch position, the stop assembly is structured to cooperate with the actuator assembly to prevent the stored energy mechanism from moving backwards.

The actuator assembly may comprise a driver, an actuator cam, and a biasing element. The actuator cam may be pivotably coupled to the driver. The actuator assembly may be movable between an open position and a compressed position, wherein the biasing element biases the actuator assembly toward the open position. The actuator assembly may further comprise a first extension member and a second extension member, wherein the first extension member extends through the driver, and wherein the second extension member extends outwardly from the actuator cam. The biasing element may be a torsion spring, wherein the torsion spring includes a first leg, a second leg, and a number of coils disposed between the first leg and the second leg. The first leg may be biased against the first extension member, and the second leg may be biased against the second extension member.

The first stop element may be a first pin member structured to extend outwardly from the housing. The actuator cam may include a first stop edge, a second stop edge, and a cam surface. The first stop edge may cooperate with the first extension member to define the open position, the second stop edge may be structured to cooperate with the first pin member and, when the stored energy mechanism is disposed in the contact touch position, the cam surface may be structured to engage and lift the stop assembly. When the stored energy mechanism moves toward the charged position, the second stop edge may be structured to engage the first pin member and the torsion spring may be compressed, thereby moving the actuator assembly toward the compressed position to permit the stored energy mechanism to move passed the stop assembly to the charged position.

The second stop element may be a second pin member structured to extend outwardly from the housing. The stop assembly may comprise a jam stick, an actuator plate, and a spring. The actuator plate may be coupled to the jam stick, and the spring may be structured to bias the jam stick toward the second pin member. The stored energy mechanism may comprise a ram wherein, when the ram is disposed in the contact touch position, the actuator assembly is structured to pivot the stop assembly against the spring bias, thereby lifting the jam stick to engage and prevent the ram from moving backwards.

A closing assembly and an electrical switching apparatus employing the aforementioned reversal prevention mechanism, are also disclosed.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

Figure 1:
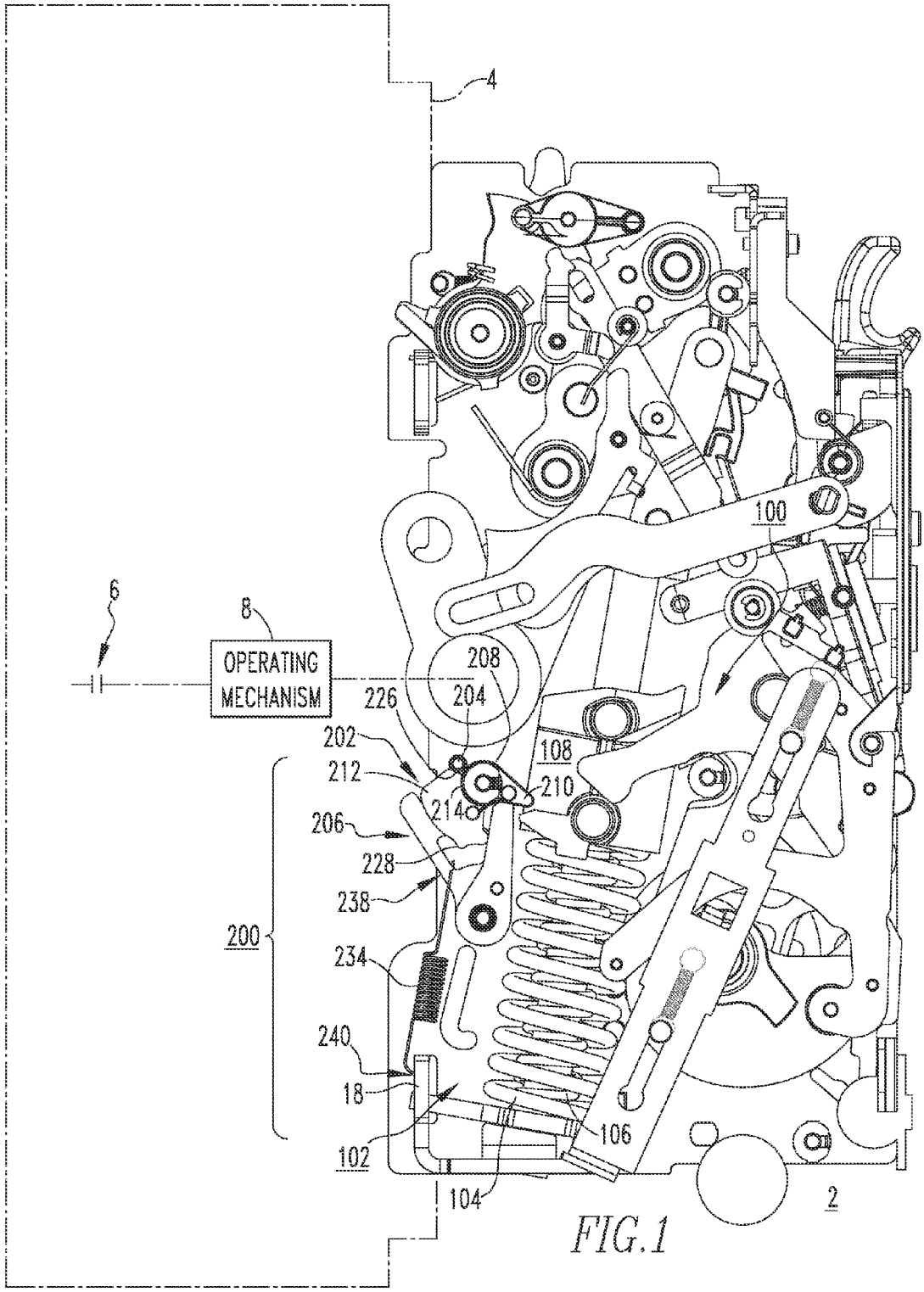
FIG. 1 is a front side elevation view of a portion of a circuit breaker, and a closing assembly and reversal protection mechanism therefor, in accordance with an embodiment of the disclosed concept, with a portion of the circuit breaker housing shown in simplified form.

Directional phrases used herein, such as, for example, left, right, upward, downward, clockwise, counterclockwise and derivatives thereof, relate to the orientation of the elements shown in the drawings and are not limiting upon the claims unless expressly recited therein.

As employed herein, the term "fastener" refers to any suitable connecting or tightening mechanism expressly including, but not limited to, screws, bolts and the combinations of bolts and nuts (e.g., without limitation, lock nuts) and bolts, washers and nuts.

As employed herein, the statement that two or more parts are "coupled" together shall mean that the parts are joined together either directly or joined through one or more intermediate parts.

As employed herein, the term "number" shall mean one or an integer greater than one (i.e., a plurality).

Figure 2:
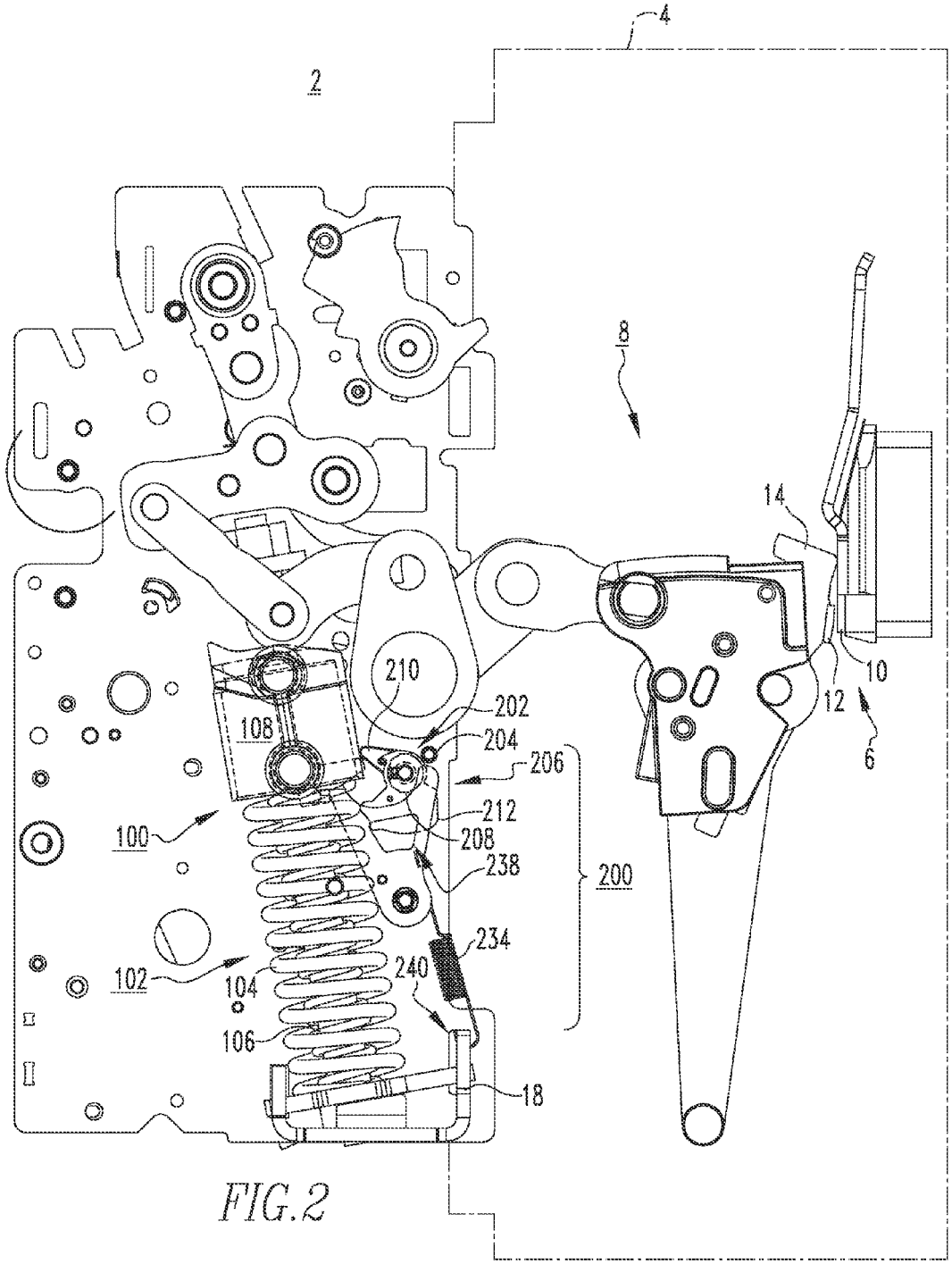
FIG. 2 is a back side elevation view of the circuit breaker, and closing assembly and reversal protection mechanism therefor of FIG. 1.
Figure 3:
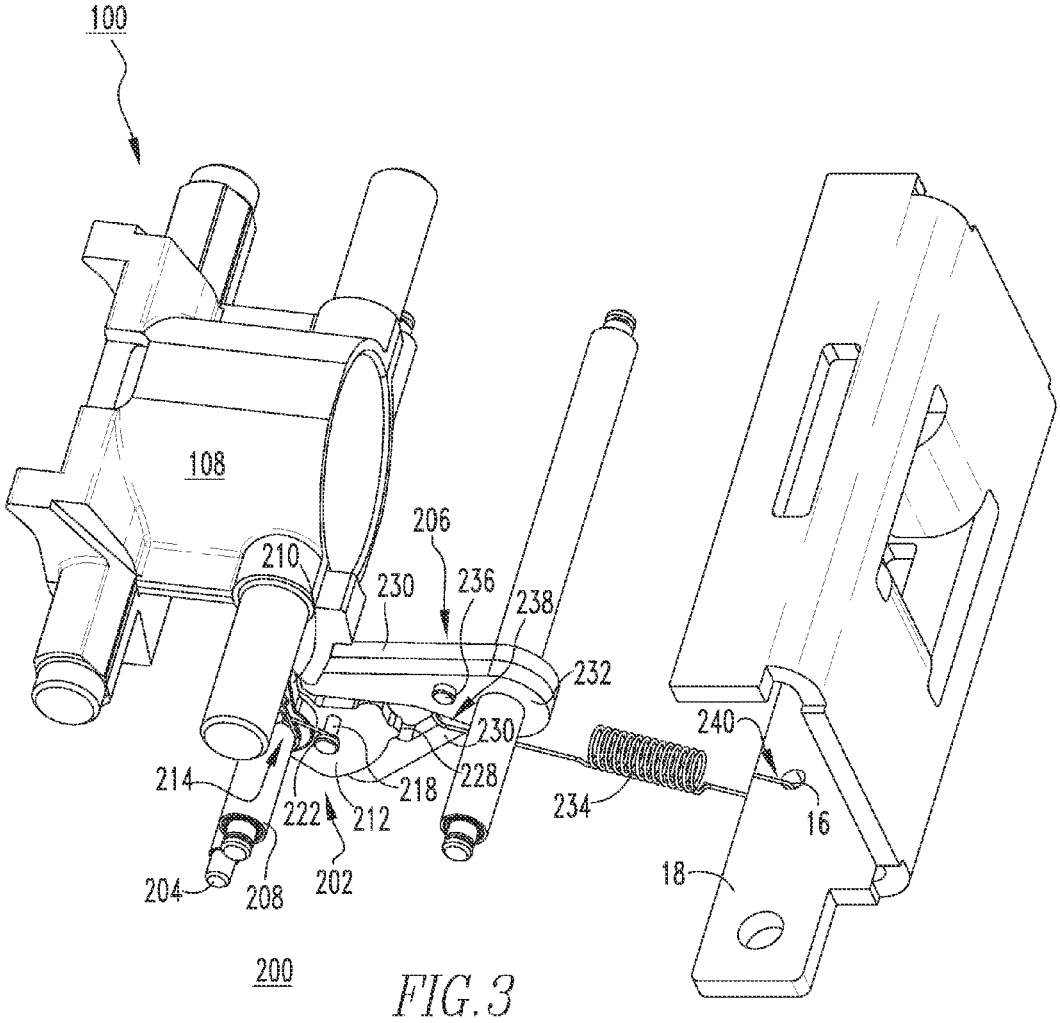
FIG. 3 is an isometric view of a portion of the closing assembly and reversal protection mechanism therefor of FIG. 2.

FIGS. 1-3 show a reversal prevention mechanism 200 for a closing assembly 100 (partially shown in FIG. 3) of an electrical switching apparatus, such as for example and without limitation, a circuit breaker 2 (partially shown in simplified form in FIGS. 1 and 2). The circuit breaker 2 includes a housing 4 (partially shown in simplified form in phantom line drawing in FIGS. 1 and 2), separable contacts 6 (shown in simplified form in FIG. 1; see also FIG. 2) enclosed by the housing 4, and an operating mechanism 8 (shown in simplified form in FIG. 1) for opening and closing the separable contacts 6.

As shown in FIGS. 1 and 2, the closing assembly 100 includes a stored energy mechanism 102. In the example shown and described herein, the stored energy mechanism 102 includes a number of springs (see, for example and without limitation, first and second closing springs 104,106 in FIGS. 1 and 2), which cooperate with a ram 108. It will be appreciated that in this type of closing assembly 100, the closing springs 104,106 directly drive the ram 108 and, in turn, associated mechanism components (e.g., without limitation, toggle links, shown but not numbered in FIGS. 1 and 2).

Among other components, the reversal prevention mechanism 200 preferably includes an actuator assembly 202 (best shown in FIGS. 4A and 4B), which is pivotably coupled to the circuit breaker housing 4, as shown in FIGS. 1 and 2, a first stop element, which in the example shown and described herein is a first pin member 204 extending outwardly from the circuit breaker housing 4 and being structured to control movement of the actuator assembly 202, a stop assembly 206 (best shown in FIGS. 5A and 5B) also pivotably coupled to the circuit breaker housing 4, and a second stop element, which in the example shown and described herein is a second pin member 208 extending outwardly from the circuit breaker housing 4 and being structured to control movement of the stop assembly 206.

Figure 7:
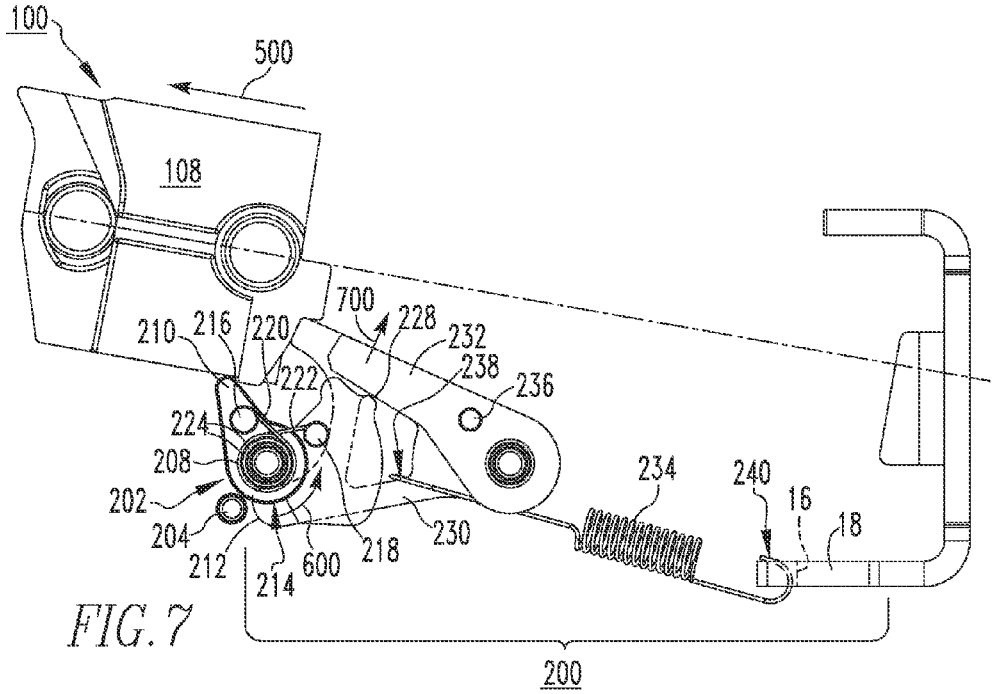
FIG. 7 is a is a side elevation view of the portion of the closing assembly and reversal protection mechanism therefor, shown in the contact touch position.
Figure 8:
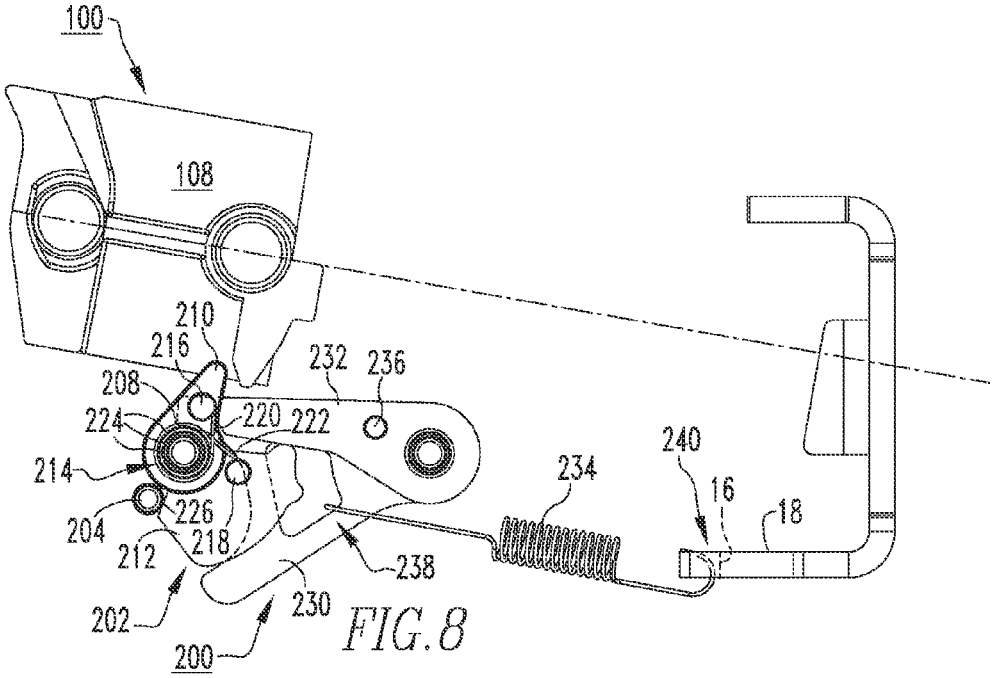
FIG. 8 is a is a side elevation view of the portion of the closing assembly and reversal protection mechanism therefor, shown in the charged position.
Figure 9:
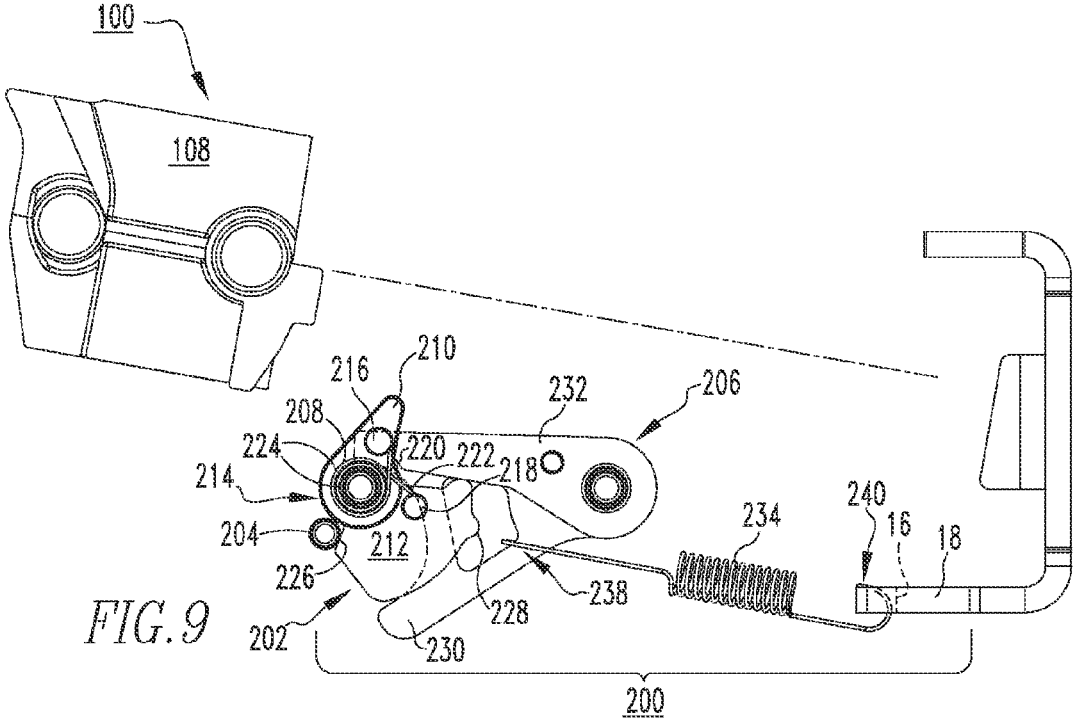
FIG. 9 is a is a side elevation view of the closing assembly and reversal protection mechanism therefor, shown in the discharged position.

The stored energy mechanism 102 is movable among a charged position (FIGS. 1 and 8), a discharged position (FIG. 9), and a contact touch position (FIGS. 2 and 7). The contact touch position corresponds to a point at which the aforementioned separable contacts 6 first make initial electrical contact, thereby completing the electrical circuit. More specifically, as shown in FIG. 2, the separable contacts 6 preferably include a number of fixed contacts 10 and a number of movable contacts 12 disposed on movable arms 14. The movable arms 14 permit the movable contacts 12 to pivot into and out of electrical contact with corresponding fixed contacts 10. In FIG. 2, arm 14 and movable contact 12 disposed thereon are shown in the contact touch position, also commonly referred to as the "toe touch" position, wherein the toe or forward portion of the movable contact arm 14 first contacts the fixed contact 10. As will be described in greater detail hereinbelow, when the stored energy mechanism 102 is disposed in the contact touch position of FIGS. 2 and 7, the stop assembly 208 of the disclosed reversal prevention mechanism 200 advantageously functions to cooperate with the actuator assembly 202 to prevent the stored energy mechanism 102 from moving backwards. In this manner, the disclosed concept provides a mechanism for preventing undesired blowback in the circuit breaker 2, which greatly aids in the circuit breaker tripping process.

Figure 4A:
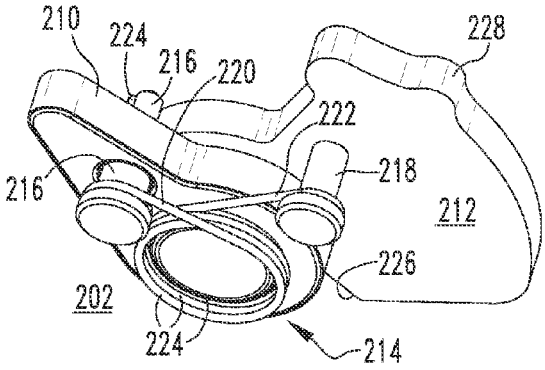
FIGS. 4A and 4B are front isometric and back isometric views, respectively, of a portion of the reversal protection mechanism of FIG. 3.
Figure 4B:
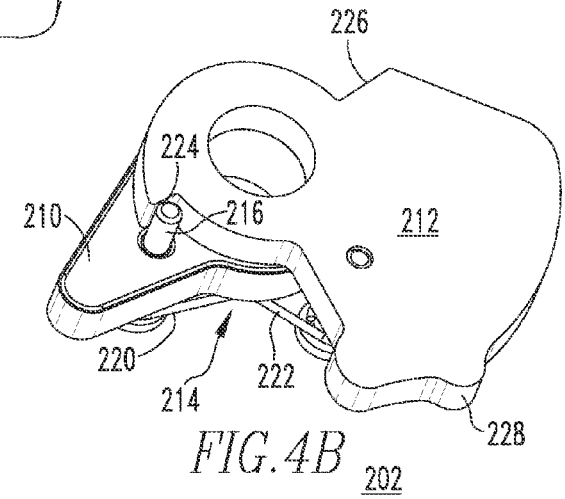
Figure 6:
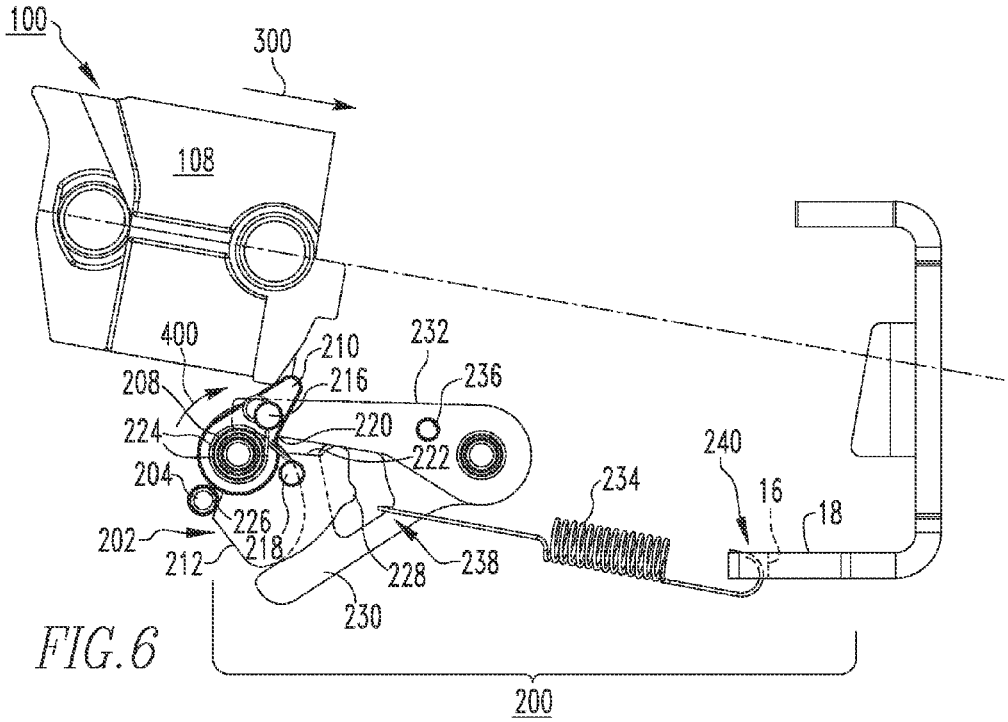
FIG. 6 is a side elevation view of a portion of the closing assembly and reversal protection mechanism therefor, shown in the charging position.

As best shown in FIGS. 4A and 4B, the example actuator assembly 202 includes a driver 210, an actuator cam 212, and a biasing element 214. The actuator cam 212 is pivotably coupled to the driver 210, and both the driver 210 and the actuator cam 212 are pivotably disposed on the aforementioned second pin member 208 (see, for example, FIGS. 3 and 6-9). The actuator assembly 202 is movable between an open position (FIGS. 1-4B and 7-9) and a compressed position (FIG. 6), corresponding to the stored energy mechanism 102 (shown in FIGS. 1 and 2; not shown in FIGS. 3 and 6-9 for ease of illustration) being charged. That is, when the stored energy mechanism 102 (FIGS. 1 and 2) is being charged, the ram 108 moves in the direction of arrow 300 (e.g., to the right from the perspective of FIG. 6), thereby engaging the driver 210 and pivoting it in the direction of arrow 400 (e.g., clockwise from the perspective of FIG. 6), compressing the biasing element 214 as the actuator assembly 202 moves toward the compressed position. This permits the ram 108 to move past the reversal prevention mechanism 200 to charge the closing spring(s) (e.g., without limitation, closing springs 104,106 of FIGS. 1 and 2). Accordingly, it will be appreciated that the biasing element 214 biases the actuator assembly 202 toward the aforementioned open position.

As shown in FIG. 4A, the actuator assembly 202 further includes a first extension member 216 (e.g., without limitation, fastener pin; rivet) and a second extension member 218 (e.g., without limitation, fastener pin; rivet). The first extension member 216 extends through the driver 210, as shown. The second extension member 218 extends outwardly from the actuator cam 212. The example biasing element is a torsion spring 214, which includes first and second legs 220,222 and a number of coils 224 disposed therebetween. The first leg 220 of the torsion spring 214 is biased against the first extension member 216, and the second leg 222 of the torsion spring 214 is biased against the second extension member 218, as shown.

Continuing to refer to FIG. 4A, and also to 4B, it will be appreciated that the example actuator cam 212 includes a first stop edge 224, a second stop edge 226, and a camp surface 228. The first stop edge 224 cooperates with the first extension member 216 on the back side of the driver 210, as best shown in FIG. 4B, to define the aforementioned opened position of the actuator assembly 202. The second stop edge 226 cooperates with the first pin member 204, as shown in FIGS. 1, 6, 8 and 9. When the stored energy mechanism 102 (FIGS. 1 and 2) and, in particular the ram 108, is disposed in the contact touch position of FIGS. 2 and 7, as the ram moves in the direction of arrow 500 (e.g., to the left from the perspective of FIG. 7), the actuator assembly 202 pivots in the direction of arrow 600 (e.g., counterclockwise from the perspective of FIG. 7), which causes the cam surface 228 of the actuator cam 212 to engage and lift (e.g., move upward in the direction of arrow 700 from the perspective of FIG. 7) the stop assembly 206. The stop assembly 206 and, in particular, the jam stick 230 (discussed hereinbelow) thereof are, therefore, positioned to prevent (e.g., stop) the ram 108 from undesirably moving backwards (e.g., to prevent blow-back).

Figure 5A:
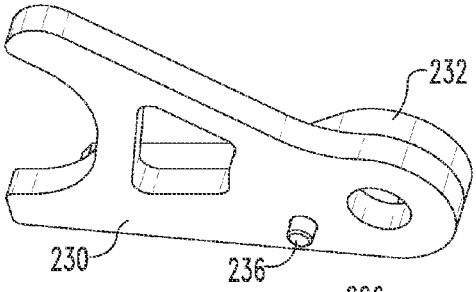
FIGS. 5A and 5B are front isometric and back isometric views, respectively, of another portion of the reversal protection mechanism of FIG. 3.
Figure 5B:
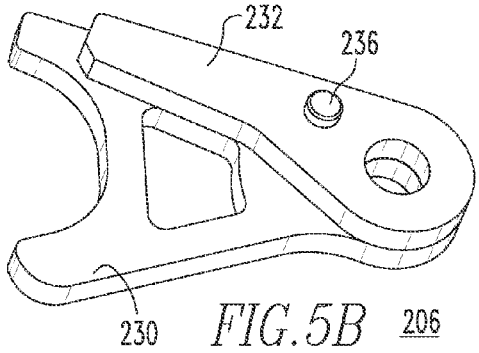

As best shown in FIGS. 5A and 5B, the stop assembly 206 of the example reversal prevention mechanism 200 preferably includes the aforementioned jam stick 230, an actuator plate 232, and a spring 234. The actuator plate 232 is coupled to the jam stick 230. More specifically, in the example shown and described herein, the actuator plate 232 is riveted to the jam stick 230 by a rivet 236, such that the two components 230, 232 preferably do not move independently with respect to one another. The spring 234 biases the jam stick 230 toward engagement with the second pin member 208, as shown in FIGS. 1, 3, 6, 8 and 9. Specifically, the spring 234 includes a first end 238, which engages the jam stick 230, as shown in FIGS. 3 and 6-9, and a second end 240, which extends through a hole 16 (FIGS. 3 and 6) in a bracket 18 of the circuit breaker housing 4. It will, however, be appreciated that any known or suitable alternative mechanism (not shown) and/or configuration thereof (not shown) could be employed to suitably control movement of the stop assembly 206, without departing from the scope of the disclosed concept.

As previously discussed hereinabove, in operation, when the stored energy mechanism 102 (FIGS. 1 and 2) and, in particular, the ram 108 thereof, is disposed in the contact touch position of FIGS. 2 and 7, the actuator assembly 202 pivots the stop assembly 206 against the spring-bias of spring 234, thereby lifting (e.g., moving upward in the direction of arrow 700 from the perspective of FIG. 7) the jam stick 230 to engage and prevent the ram 108 from undesirably moving backwards.

Accordingly, it will be appreciated that the disclosed reversal prevention mechanism 200 effectively works in connection with the components (see, for example and without limitation, closing springs 104,106 and ram 108 of FIGS. 1 and 2) of the circuit breaker closing assembly 100 to prevent undesired blow-backs, without inhibiting recharging of the stored energy mechanism (see, for example and without limitation, closing springs 104,106 of FIGS. 1 and 2).

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. A reversal prevention mechanism for a closing assembly of an electrical switching apparatus, said electrical switching apparatus including a housing, separable contacts enclosed by the housing, and an operating mechanism for opening and closing said separable contacts, said closing assembly including a stored energy mechanism, said reversal prevention mechanism comprising:

an actuator assembly structured to be pivotably coupled to the housing;

a first stop element for controlling movement of said actuator assembly;

a stop assembly structured to be pivotably coupled to the housing; and a second stop element for controlling movement of said stop assembly, wherein said stored energy mechanism is movable among a charged position, a discharged position, and a contact touch position corresponding to a point at which said separable contacts make initial electrical contact, wherein, when said stored energy mechanism is disposed in said contact touch position, said stop assembly is structured to cooperate with said actuator assembly to prevent said stored energy mechanism from moving backwards, wherein said actuator assembly comprises a driver, an actuator cam, and a biasing element; wherein said actuator cam is pivotably coupled to said driver; wherein said actuator assembly is movable between an open position and a compressed position; and wherein said biasing element biases said actuator assembly toward said open position, and wherein said actuator assembly further comprises a first extension member and a second extension member, wherein said first extension member extends through said driver, wherein said second extension member extends outwardly from said actuator cam; wherein said biasing element is a torsion spring; wherein said torsion spring includes a first leg, a second leg, and a number of coils disposed between the first leg and the second leg;

wherein said first leg is biased against said first extension member; and wherein said second leg is biased against said second extension member.

2. A The reversal prevention mechanism of claim 1 wherein said first stop element is a first pin member structured to extend outwardly from the housing;

wherein said actuator cam includes a first stop edge, a second stop edge, and a cam surface; wherein said first stop edge cooperates with said first extension member to define said open position; wherein said second stop edge is structured to cooperate with said first pin member; and wherein, when said stored energy mechanism is disposed in said contact touch position, said cam surface is structured to engage and lift said stop assembly.

3. The reversal prevention mechanism of claim 2 wherein, when said stored energy mechanism moves toward said charged position, said second stop edge is structured to engage said first pin member and said torsion spring is compressed, thereby moving said actuator assembly toward said compressed position to permit said stored energy mechanism to move passed said stop assembly to said charged position.

4. A reversal prevention mechanism for a closing assembly of an electrical switching apparatus, said electrical switching apparatus including a housing, separable contacts enclosed by the housing, and an operating mechanism for opening and closing said separable contacts, said closing assembly including a stored energy mechanism, said reversal prevention mechanism comprising:

an actuator assembly structured to be pivotably coupled to the housing;

a first stop element for controlling movement of said actuator assembly;

a stop assembly structured to be pivotably coupled to the housing; and a second stop element for controlling movement of said stop assembly, wherein said stored energy mechanism is movable among a charged position, a discharged position, and a contact touch position corresponding to a point at which said separable contacts make initial electrical contact, wherein, when said stored energy mechanism is disposed in said contact touch position, said stop assembly is structured to cooperate with said actuator assembly to prevent said stored energy mechanism from moving backwards, and wherein said second stop element is a second pin member structured to extend outwardly from the housing;

wherein said stop assembly comprises a jam stick, an actuator plate, and a spring;

wherein said actuator plate is coupled to said jam stick; and wherein said spring is structured to bias said jam stick toward said second pin member.

5. The reversal prevention mechanism of claim 4 wherein said stored energy mechanism comprises a ram; wherein, when said ram is disposed in said contact touch position, said actuator assembly is structured to pivot said stop assembly against said spring bias, thereby lifting said jam stick to engage and prevent said ram from moving backwards.

6. A closing assembly for an electrical switching apparatus, said electrical switching apparatus comprising a housing, separable contacts enclosed by the housing, and an operating mechanism for opening and closing said separable contacts, said closing assembly comprising:

a stored energy mechanism; and a reversal prevention mechanism comprising:

an actuator assembly structured to be pivotably coupled to the housing, a first stop element for controlling movement of said actuator assembly;

a stop assembly structured to be pivotably coupled to the housing; and a second stop element for controlling movement of said stop assembly, wherein said stored energy mechanism is movable among a charged position, a discharged position, and a contact touch position corresponding to a point at which said separable contacts make initial electrical contact, wherein, when said stored energy mechanism is disposed in said contact touch position, said stop assembly cooperates with said actuator assembly to prevent said stored energy mechanism from moving backwards, wherein said actuator assembly comprises a driver, an actuator cam, and a biasing element; wherein said actuator cam is pivotably coupled to said driver; wherein said actuator assembly is movable between an open position and a compressed position; and wherein said biasing element biases said actuator assembly toward said open position, and wherein said actuator assembly further comprises a first extension member and a second extension member;

wherein said first extension member extends through said driver; wherein said second extension member extends outwardly from said actuator cam; wherein said biasing element is a torsion spring; wherein said torsion spring includes a first leg, a second leg, and a number of coils disposed between the first leg and the second leg; wherein said first leg is biased against said first extension member; and wherein said second leg is biased against said second extension member.

7. The closing assembly of claim 6 wherein said first stop element is a first pin member extending outwardly from the housing; wherein said actuator cam includes a first stop edge, a second stop edge, and a cam surface; wherein said first stop edge cooperates with said first extension member to define said open position; wherein said second stop edge cooperates with said first pin member; and wherein, when said stored energy mechanism is disposed in said contact touch position, said cam surface engages and lifts said stop assembly.

8. The closing assembly of claim 7 wherein, when said stored energy mechanism moves toward said charged position, said second stop edge engages said first pin member and said torsion spring is compressed, thereby moving said actuator assembly toward said compressed position to permit said stored energy mechanism to move passed said stop assembly to said charged position.

9. A closing assembly for an electrical switching apparatus, said electrical switching apparatus comprising a housing, separable contacts enclosed by the housing, and an operating mechanism for opening and closing said separable contacts, said closing assembly comprising:

a stored energy mechanism; and a reversal prevention mechanism comprising:

an actuator assembly structured to be pivotably coupled to the housing, a first stop element for controlling movement of said actuator assembly;

a stop assembly structured to be pivotably coupled to the housing; and a second stop element for controlling movement of said stop assembly, wherein said stored energy mechanism is movable among a charged position, a discharged position, and a contact touch position corresponding to a point at which said separable contacts make initial electrical contact, wherein, when said stored energy mechanism is disposed in said contact touch position, said stop assembly cooperates with said actuator assembly to prevent said stored energy mechanism from moving backwards, and wherein said second stop element is a second pin member structured to extend outwardly from the housing;

wherein said stop assembly comprises a jam stick, an actuator plate, and a spring;

wherein said actuator plate is coupled to said jam stick; and wherein said spring biases said jam stick toward said second pin member.

10. The closing assembly of claim 9 wherein said stored energy mechanism comprises a ram; wherein, when said ram is disposed in said contact touch position, said actuator assembly pivots said stop assembly against said spring bias, thereby lifting said jam stick to engage and prevent said ram from moving backwards.

11. An electrical switching apparatus comprising:

a housing;

separable contacts enclosed by the housing;

an operating mechanism for opening and closing said separable contacts; and a closing assembly comprising:

a stored energy mechanism, and a reversal prevention mechanism comprising:

an actuator assembly pivotably coupled to the housing, a first stop element for controlling movement of said actuator assembly;

a stop assembly pivotably coupled to the housing; and a second stop element for controlling movement of said stop assembly, wherein said stored energy mechanism is movable among a charged position, a discharged position, and a contact touch position corresponding to a point at which said separable contacts make initial electrical contact, wherein, when said stored energy mechanism is disposed in said contact touch position, said stop assembly cooperates with said actuator assembly to prevent said stored energy mechanism from moving backwards, wherein said actuator assembly comprises a driver, an actuator cam, and a biasing element; wherein said actuator cam is pivotably coupled to said driver; wherein said actuator assembly is movable between an open position and a compressed position; and wherein said biasing element biases said actuator assembly toward said open position, and wherein said actuator assembly further comprises a first extension member and a second extension member; wherein said first extension member extends through said driver;

wherein said second extension member extends outwardly from said actuator cam;

wherein said biasing element is a torsion spring; wherein said torsion spring includes a first leg, a second leg, and a number of coils disposed between the first leg and the second leg; wherein said first leg is biased against said first extension member, and wherein said second leg is biased against said second extension member.

12. The electrical switching apparatus of claim 11 wherein said first stop element is a first pin member extending outwardly from the housing; wherein said actuator cam includes a first stop edge, a second stop edge, and a cam surface; wherein said first stop edge cooperates with said first extension member to define said open position; wherein said second stop edge cooperates with said first pin member; and wherein, when said stored energy mechanism is disposed in said contact touch position, said cam surface engages and lifts said stop assembly.

13. The electrical switching apparatus of claim 12 wherein, when said stored energy mechanism moves toward said charged position, said second stop edge engages said first pin member and said torsion spring is compressed, thereby moving said actuator assembly toward said compressed position to permit said stored energy mechanism to move passed said stop assembly to said charged position.

14. An electrical switching apparatus comprising:

a housing;

separable contacts enclosed by the housing;

an operating mechanism for opening and closing said separable contacts; and a closing assembly comprising:

a stored energy mechanism, and a reversal prevention mechanism comprising:

an actuator assembly pivotably coupled to the housing, a first stop element for controlling movement of said actuator assembly;

a stop assembly pivotably coupled to the housing; and a second stop element for controlling movement of said stop assembly, wherein said stored energy mechanism is movable among a charged position, a discharged position, and a contact touch position corresponding to a point at which said separable contacts make initial electrical contact, wherein, when said stored energy mechanism is disposed in said contact touch position, said stop assembly cooperates with said actuator assembly to prevent said stored energy mechanism from moving backwards, and wherein said electrical switching apparatus is a circuit breaker, wherein said stored energy mechanism comprises a ram; wherein said second stop element is a second pin member extending outwardly from the housing; wherein said stop assembly comprises a jam stick, an actuator plate, and a spring; wherein said actuator plate is coupled to said jam stick; wherein said spring biases said jam stick toward said second pin member, and wherein, when said ram is disposed in said contact touch position, said actuator assembly pivots said stop assembly against said spring bias, thereby lifting said jam stick to engage and prevent said ram from moving backwards.

* * * * *